US005464105A

United States Patent [19]

Mandeltort

[11] Patent Number: 5,464,105

[45] Date of Patent: Nov. 7, 1995

[54] MULTIPLE ITEM SHELVING DISPLAY SYSTEM

[75] Inventor: Stanley T. Mandeltort, Lincolnshire, Ill.

[73] Assignee: Deluxe Craft Manufacturing Co., Chicago, Ill.

[21] Appl. No.: 111,652

[22] Filed: Aug. 25, 1993

[51] Int. Cl.[6] ..... A47F 5/00

[52] U.S. Cl. ..... 211/184; 108/61

[58] Field of Search ..... 211/184, 90, 59.2, 211/186; 108/60, 61

[56] References Cited

U.S. PATENT DOCUMENTS

| | | | |
|---|---|---|---|
| 107,753 | 9/1870 | Belding . | |
| 999,974 | 8/1911 | Fauth . | |
| 3,481,485 | 12/1969 | Hess | 108/61 |
| 3,497,081 | 2/1970 | Field | 211/184 |
| 3,669,278 | 6/1972 | Heroy | 211/184 |
| 4,183,438 | 1/1980 | Huczek | 211/49 D |
| 4,331,243 | 5/1982 | Doll | 211/49 D |
| 4,356,923 | 11/1982 | Young et al. | 211/49 D |
| 4,474,297 | 10/1984 | Zucker | 211/49 D |
| 4,503,982 | 3/1985 | Lewis | 211/184 |
| 4,905,847 | 3/1990 | Hanson | 211/184 |
| 5,165,316 | 11/1992 | Hayes | 83/522.17 |

OTHER PUBLICATIONS

*Quality Photo Albums,* a product brochure published by Deluxe Craft Manufacturing Co. in the 1970's.

Proposal made to Wal–Mart, Aug. 12, 1992, describing a photo–album shelf. Photographs A–E, depicting the shelf described in this proposal and shown to Wal–Mart.

*Primary Examiner*—Alvin C. Chin-Shue

*Attorney, Agent, or Firm*—Marshall, O'Toole, Gerstein, Murray & Borun

[57] ABSTRACT

A shelving system capable of displaying multiple items, such as photo albums and their associated photo album refills, is used in conjunction with a flat shelf and includes a plurality of separated shelving members attached to the flat shelf at spaced-apart locations from one another. Each shelving member includes a ledge, a riser, which supports the ledge above the flat shelf so that a space exists between the ledge and the flat shelf, and a connector capable of attaching the shelving member to the flat shelf. First and second adjacent, spaced-apart shelving members accept a photo album on the ledges thereof and accept an associated photo album refill in the space between the ledges thereof and the flat shelf. Furthermore, each shelving member includes a flat, vertical surface which displays sensorially perceptible information pertaining to the photo album and/or the photo album refill, which are marked with a similar identification, to enable a person to determine the photo album refill associated with any particular photo album and/or shelving member in an easy and efficient manner.

9 Claims, 3 Drawing Sheets

FIGURE 4a
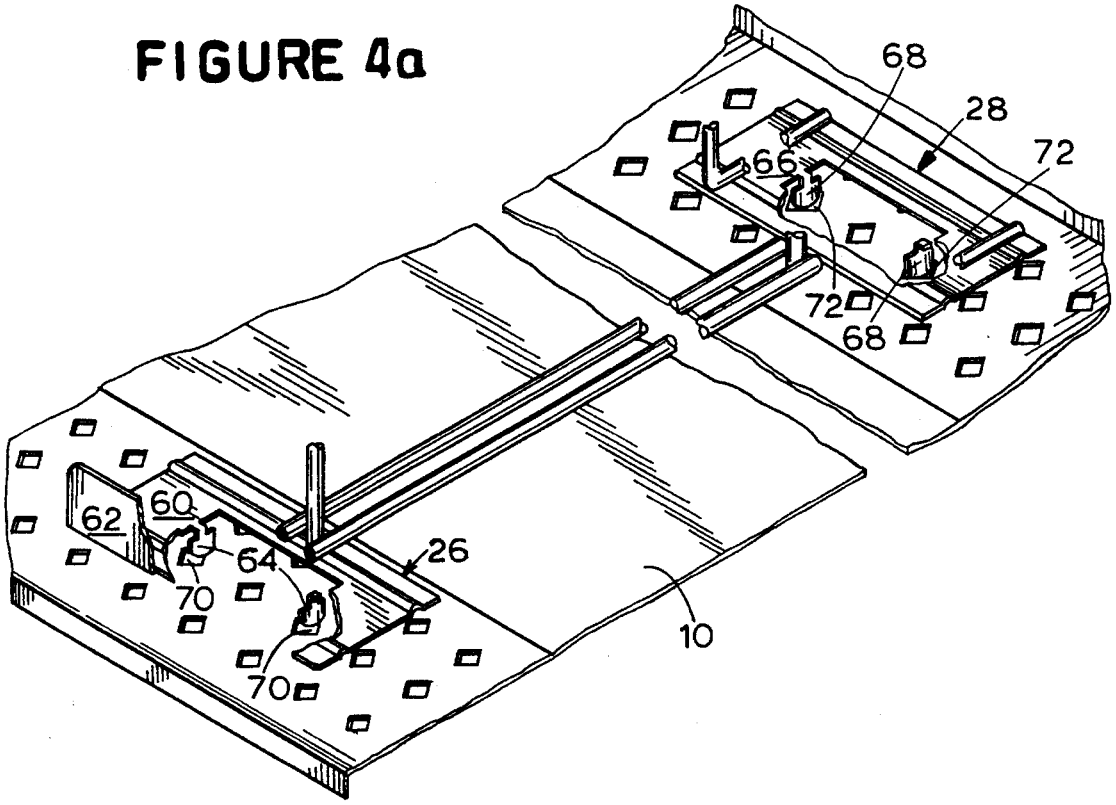
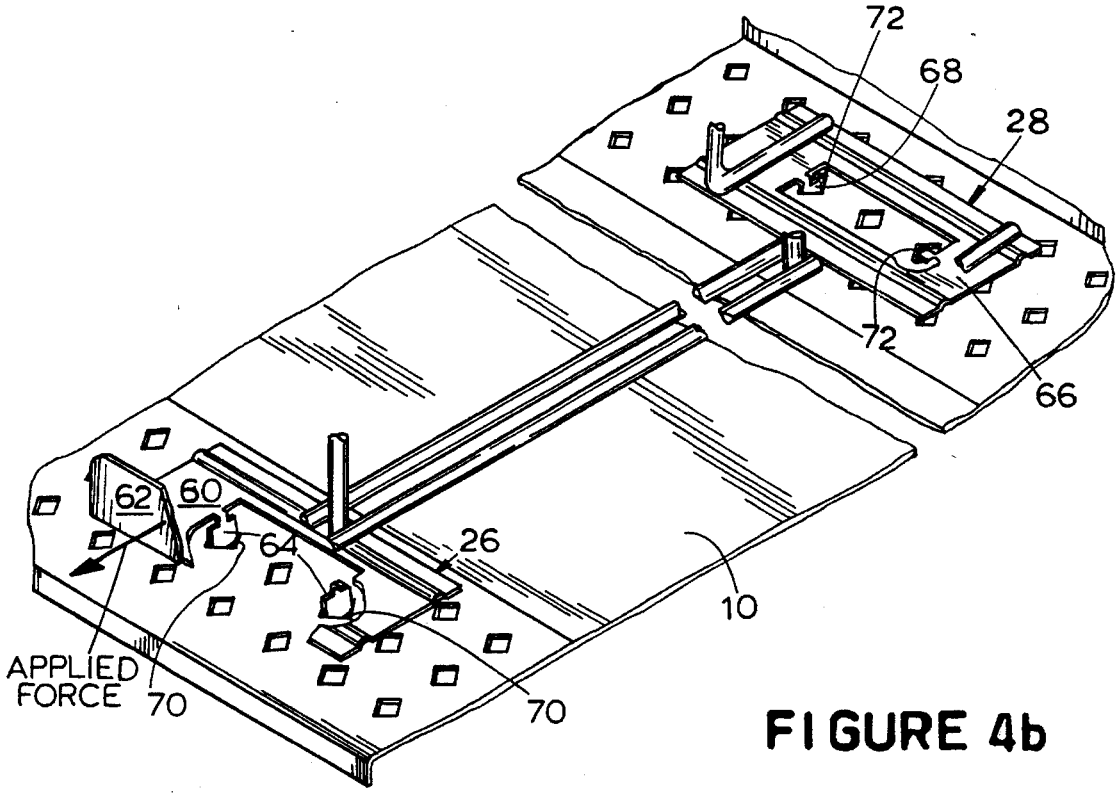
FIGURE 4b

MULTIPLE ITEM SHELVING DISPLAY SYSTEM

TECHNICAL FIELD

The present invention relates generally to shelving systems, and more particularly to a shelving display system for use in storing and displaying photo albums and their associated photo album refills.

BACKGROUND ART

It is commonly known to display items which are for sale in, for example, department stores and convenience stores with the use of a plurality of flat shelves spaced at predetermined vertical distances from one another. These shelves may be positioned in a horizontal or slightly diagonal direction to enable items to be conveniently stored and displayed thereon. It is also known to provide dividers attached to the surfaces of these shelves for further supporting the items placed on the shelves and for separating the items on any particular shelf from one another. These prior art shelving systems are particularly suitable for storing and displaying multiple, non-related items, such as packages, boxes, bottles and cans, having either the same or similar shapes and/or sizes.

Such known prior art shelving systems include those disclosed in U.S. Pat. No. 4,183,438 and in U.S. Pat. No. 4,905,847, which include multiple, diagonally oriented shelves having a plurality of dividers attached thereto. Each of the dividers has a front wall, which provides support to items placed on the shelf, and a side wall, which divides the shelf into different sized compartments capable of storing rectangular or box-shaped items therein. Each divider also includes a ledge which is positioned directly on top of the shelf and which accepts a display item thereon.

U.S. Pat. No. 4,331,243 discloses multiple, diagonally oriented, wire shelves having wire dividers. These shelves are particularly adapted to store and dispense dairy product containers, such as milk cartons. U.S. Pat. No. 999,974 discloses a horizontally disposed flat shelf having multiple wire dividers located at regular intervals thereon, for use in sorting and storing different types of papers, such as invoices and bills. Still further, U.S. Pat. No. 4,503,982 discloses a dispenser for drinking containers which includes a flat shelf having metal dividers positioned thereon to separate and support cups, lids and straws placed on the flat shelf. This dispenser further includes two angle plates which support the flat shelf above a flat surface and which orient the flat shelf in a diagonal direction with respect to the flat surface.

Other prior art shelving display systems include rack systems, such as those disclosed in U.S. Pat. No. 4,474,297 and U.S. Pat. No. 4,356,923, which include a series of sloping shelves stacked on top of one another. The sloping shelves are separated vertically by risers which also serve to divide each of the sloping shelves into horizontal compartments. These rack systems are particularly useful in storing, displaying and dispensing cylindrical objects, such as cans and bottles.

Although these known shelving display systems allow multiple width, non-related items to be displayed adjacent one another on a shelf, they are considered inadequate for displaying multiple sets of related items, such as photo albums and their associated photo album refills, in an efficient and orderly manner. This is particularly true when the related items are of significantly different sizes and shapes, as are photo albums and their associated photo album refills.

Currently, photo albums and their associated refills are placed on separate, but not necessarily adjacent, shelves, which causes confusion in the mind of a customer as to which refill is associated with any particular photo album, or photo albums and their associated refills are stored horizontally adjacent to one another on a single shelf, which is an inefficient use of shelving space. It is desirable, therefore, to provide a shelving display system capable of displaying photo albums, which come in many different varieties and sizes, in close proximity to their associated photo album refills while simultaneously utilizing a minimal amount of shelving space.

SUMMARY OF THE INVENTION

In accordance with one aspect of the present invention, a shelving display system is capable of displaying multiple, related items, such as photo albums and their associated refills, when used in conjunction with a flat shelf. The shelving system includes a plurality of separated shelving members which are capable of being attached to the flat shelf at any of a plurality of locations to create one or more shelving compartments of either the same or different sizes. Each shelving member includes a flat ledge, a support member or a riser attached to the flat ledge and a connector capable of attaching the riser to the flat shelf. The riser supports the flat ledge at a predetermined height above the flat shelf to create a space between the flat ledge and the flat shelf.

When attached to the flat shelf, any two adjacent, but separated shelving members are capable of accepting a first item, such as a photo album, on the ledges thereof, and of accepting a second, related item, such as a photo album refill associated with the photo album, in the space between the ledges of the shelving members and the flat shelf. When multiple shelving members are attached to the flat shelf at different spaced-apart locations, the shelving system is capable of storing and displaying different-sized photo albums and their associated refills.

Preferably, the flat shelf is a perforated shelf and the connector associated with each shelving member includes pegs or clips which are capable of being inserted into the holes of the perforated shelf to anchor the shelving member thereon. Each riser further includes first and second separated portions which are attached to the flat ledge of the associated shelving member and which are bendable with respect to one another to enable the pegs of the connectors to be inserted into holes of the perforated shelf. Also preferably, each shelving member includes a lateral support member disposed above the flat ledge of the shelving member to provide lateral support to a photo album when the photo album is placed on the flat ledge.

In this manner, photo albums and their associated refills are displayed vertically adjacent to one another above a single flat shelf so as to prevent confusion in the mind of a customer as to which refill is associated to a particular photo album while simultaneously minimizing the amount of shelving space required to store and display these items.

In accordance with another aspect of the present invention, each shelving member includes a surface which displays a color-coded identification marking and which includes information pertaining to the photo albums and/or the photo album refills stored and displayed by that shelving member. Furthermore, the same or similar identification marking is placed on each of the photo albums and their associated photo album refills stored and displayed by that shelving member so as to enable a customer to choose the photo album refill associated with any particular photo album in an easy and efficient manner.

BRIEF DESCRIPTION OF THE DRAWING

FIGS. 4*a* and 4*b* are perspective, cut-a-way views of the connector show in FIG. 3, illustrated in conjunction with a perforated shelf.

DESCRIPTION OF THE PREFERRED EMBODIMENT

Figure 1:
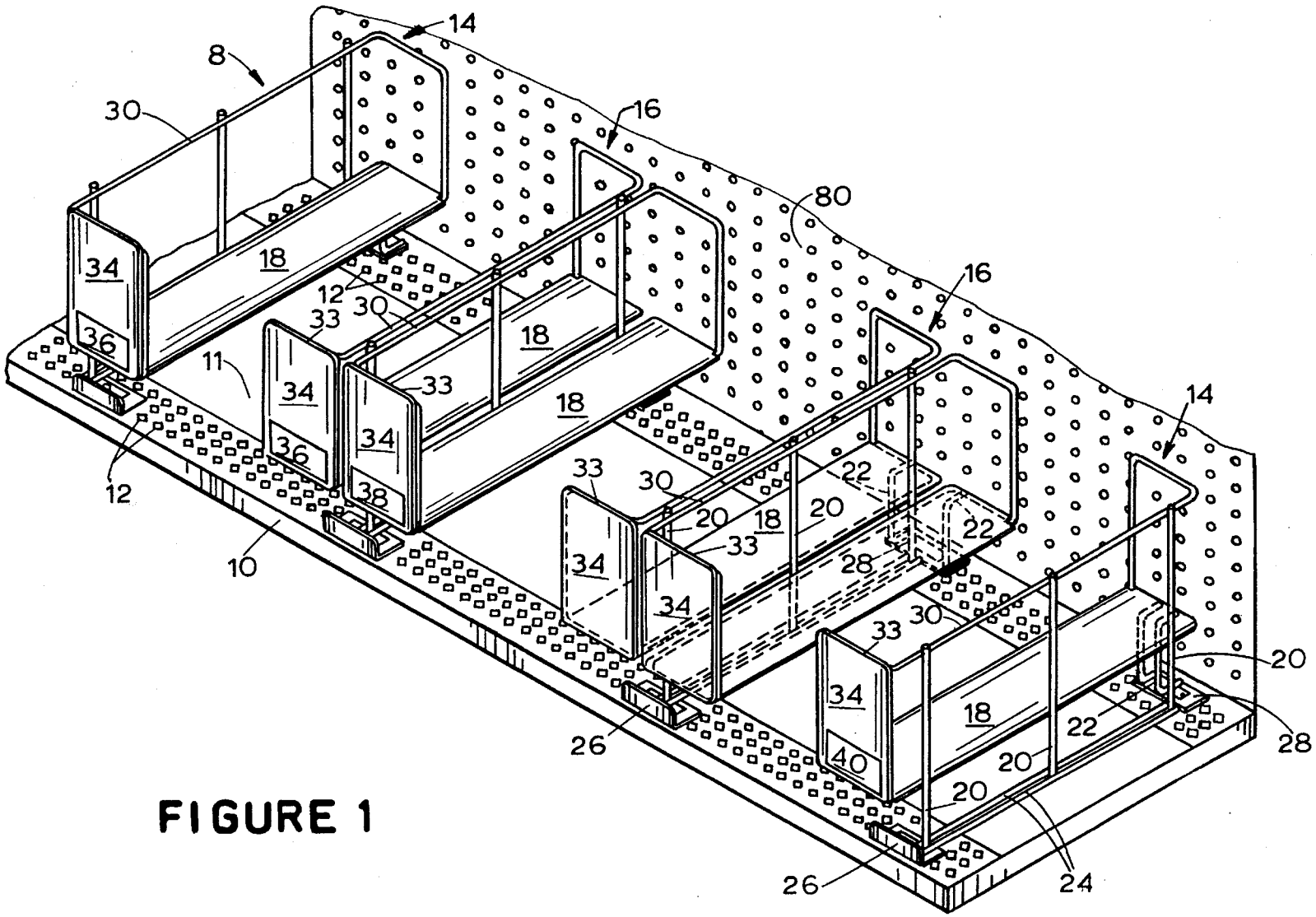
FIG. 1 is a perspective view of a shelving system according to the present invention used in conjunction with a flat shelf.

FIG. 1 is a perspective view of a shelving display system, denoted generally by the reference numeral 8, for use in conjunction with a flat shelf 10. Preferably, the flat shelf 10 is a perforated shelf having a flat upper surface 11 with holes 12 therein but could, alternatively, be any other type of shelf desired, such as a wire shelf. The holes 12 are preferably diamond shaped but could, instead, be circular-shaped or any other desired shape.

The shelving system 8 includes multiple shelving members, denoted generally with reference numerals 14 and 16, which are attached to the flat shelf 10. Each of the shelving members 14 is an end shelving piece and includes a flat ledge 18 which is supported at a predetermined height, which is preferably greater than one inch, above the surface 11 by two sets of generally vertically disposed rods 20 and 22, preferably made of metal. Each of the shelving members 16 is a middle shelving piece and includes two flat ledges 18 which are supported at the predetermined height above the surface 11 by two sets of generally, vertically disposed rods 20 and 22 (shown in partial phantom relief in FIG. 1). For each of the shelving members 14 and 16, a middle portion of each of the rods 20 is connected to the ledge 18 while a lower portion of each of the rods 20 is connected to a set of generally horizontally disposed rods 24 which are, in turn, attached to a connector 26. Likewise, for each of the shelving members 14 and 16, an upper portion of each of the rods 22 is connected to the ledge 18 while a lower portion of each of the rods 22 is attached to a connector 28. The connectors 26 and 28 attach the shelving members 14 and 16 to the perforated shelf 10 as described in more detail hereinafter.

A rod 30, preferably made of metal, connects to an upper portion of each of the rods 20 so that a portion of the rod 30 runs parallel to and is directly above a side edge of the ledge 18. The rod 30 includes approximately 90 degree bends and includes portions which run parallel to and which are directly above front and back edges of the ledge 18 and further includes vertical portions which attach to the ledge 18 at the front and back edges thereof. The rod 30, along with the portions of the rods 20 above the ledge 18, comprise a lateral support member which provides lateral support in three directions to an item placed on any two adjacent, but separated ledges 18. Furthermore, the rods 22 and the portions of the rods 20 below the ledge 18 comprise vertical support members or risers which support the ledge 18 at the predetermined height above the flat shelf 10.

Each of the shelving members 14 and 16 includes one or more plates 33 which are made of, for example, a thin metal sheet, and which have a generally, vertically disposed front surface 34. A single plate 33 is associated with each one of the ledges 18 and is connected to the front edge of the ledge 18 and to the associated rod 30. Each front surface 34 includes thereon a coded identification marking 36, 38 or 40 which identifies the price or other information about an item placed either on the associated ledge 18 or on the flat shelf 10 directly beneath the associated ledge 18.

In use, a first display item, such as a photo album, is placed on the ledges 18 of any two adjacent shelving members 14 and/or 16, i.e., a shelving compartment. In this manner, the photo album is supported at the predetermined height by the ledges 18 and is also provided lateral support by the rods 30 and the upper portions of the rods 20 associated with the ledges 18 of the shelving compartment. A second item which is related to the first item, such as a photo album refill, is placed in the shelving compartment on top of the flat shelf 10 in the space below the ledges 18 of the two adjacent, but separated shelving members 14 and/or 16. It should be noted that multiple, identical photo albums can be stacked behind one another on the ledges 18 of any shelving compartment while multiple identical photo album refills can be stacked on top of one another in the space between the ledges 18 and the flat shelf 10 of the shelving compartment.

Figure 2:
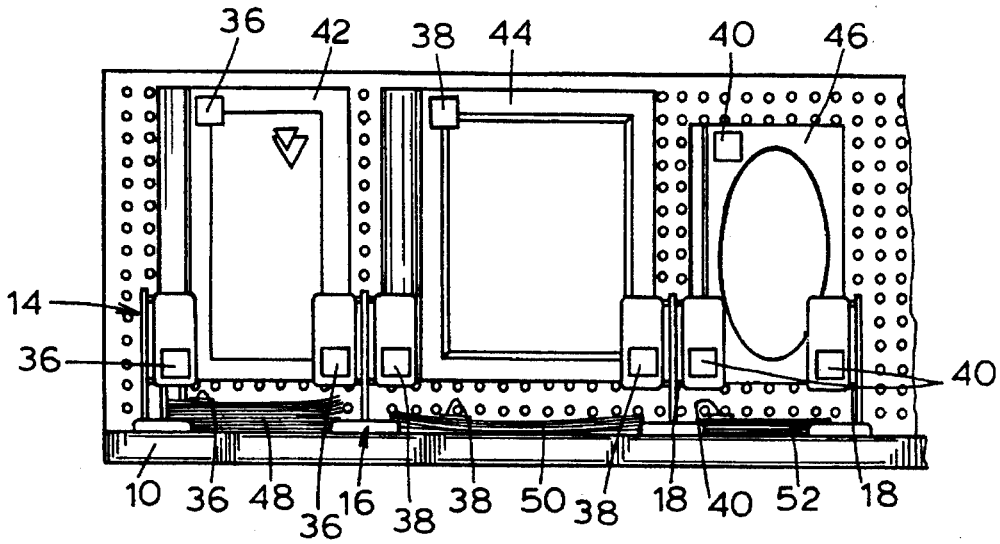
FIG. 2 is a front plan view of the shelving system according to the present invention having three photo albums and their respective refills displayed thereon.

Furthermore, as illustrated in FIGS. 1 and 2, any number of shelving members 14 and/or 16 can be attached to the flat shelf 10 at any number of separated distances in order to accommodate multiple photo albums and their associated refills of either the same or different sizes. The distance by which any two of the shelving members 14 and/or 16 are separated along the flat shelf 10 is determined by the particular width of the photo album to be stored thereon. In this manner, multiple sets of photo albums and their associated photo album refills can be stored adjacent each other above a single flat shelf while utilizing a minimal amount of shelving space.

Thus, as illustrated in FIG. 2, when four shelving members 14 and 16 are attached to the flat shelf 10 at different distances from one another, the shelving system 8 is capable of storing and displaying three different width photo albums 42, 44 and 46 on the ledges 18. Furthermore, the shelving system 8 is capable of storing and displaying photo album refills 48, 50 and 52 associated with the photo albums 42, 44 and 46, respectively, on the flat shelf 10 beneath the ledges 18.

As further illustrated in FIG. 2, the identification markings 36, 38 and 40, which are located on the plates 33 of the shelving members 14 and 16, are also located on the photo albums 42, 44 and 46 and on the photo album refills 48, 50 and 52, respectively. Preferably, the identification markings 36, 38 and 40 are printed in different colors but may include any other types of distinguishing features which enable a customer to differentiate visually easily and quickly between the photo albums 42, 44 and 46 and to match a photo album refill 48, 50 or 52 with its proper photo album 42, 44 or 46. It should be noted, however, that each identification marking associated with a particular reference numeral 36, 38 or 40 need not be identical to the other markings identified with that same reference numeral, but must only have the same color or other distinguishing visual or sensory feature in order to adequately identify the photo album and its associated refill. Thus, for example, the identification marking 36 on the shelving member 14 and on the photo album 42 of FIG. 2 may include the price of the photo album 42 and/or an arrow pointing to the photo album 42, while the marking 36 on the shelving member 16 and on the photo album refills 48 may include the price of the photo album refills 48 and/or an arrow pointing to the refills 48. All of these identification markings 36, however, must include the same color or other distinguishing feature to enable a customer to match the photo album refill 48 with the photo album 42.

Figure 3:
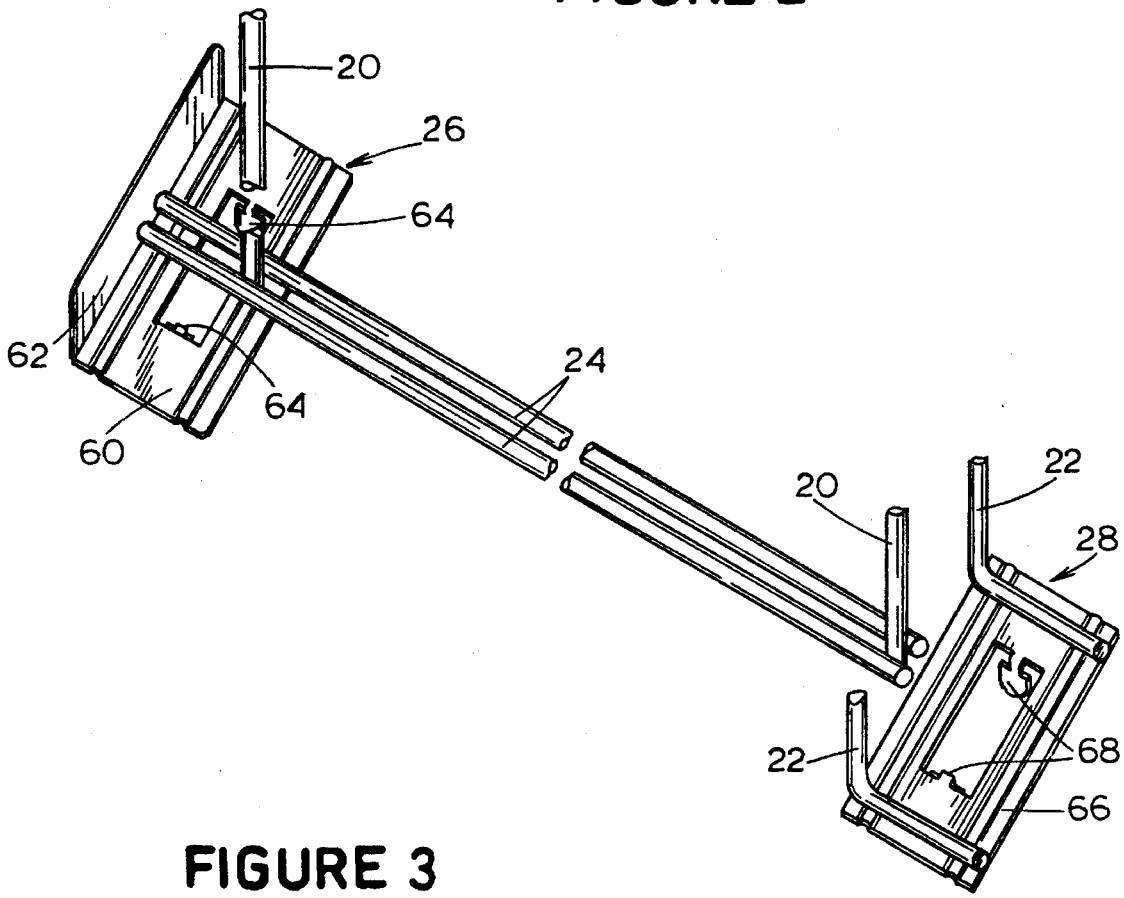
FIG. 3 is a perspective view of a connector associated with one of the shelving members shown in FIG. 1.

The connectors 26 and 28 and a method in which the connectors 26 and 28 attach the shelving members 14 and 16 to the flat shelf 10, will be described in conjunction with FIGS. 3, 4*a* and 4*b*. Referring now to FIG. 3, which is a perspective view of the connectors 26 and 28 of one of the shelving members 16, the connector 26 includes a horizontally disposed plate 60 which is located directly above the shelf 10 when the shelving member 16 is positioned on the shelf 10, and a vertically disposed plate 62 which serves to provide lateral support to the photo album refills placed on the shelf 10. Semi-circular or U-shaped pegs 64 are attached to the plate 60 and extend therebelow for insertion into the holes 12 of the perforated shelf 10 (FIG. 1). The rods 24, which are connected to the rods 20, are further connected to an upper surface of the plate 60 so that the plate 60 provides stability to a front portion of the shelving member 16 when the shelving member 16 is positioned on the flat shelf 10.

The connector 28 includes a horizontally disposed plate 66 and pegs 68 attached thereto and extending therebelow for insertion into the holes 12 of the perforated shelf 10. The rods 22 are connected to an upper surface of the plate 66 so that the plate 66 provides stability to a back portion of the shelving member 16 when the shelving member 16 is positioned on the flat shelf 10. It should be noted that neither the rods 20 nor the rods 24 connect to the plate 66 of the connector 28. In fact, as shown in FIG. 1, the plate 66 of the connector 28 only connects to the ledge 18 via the rods 22. As a result, the rods 22 are bendable with respect to the rods 20 and, therefore, the plate 66 of the connector 28 is movable with respect to the plate 60 of the connector 26.

The connectors 26 and 28 associated with the shelving member 14 are similar to the connectors 26 and 28 described above, except that, as illustrated in FIG. 1, the rods 20, 24 and the rods 22 are attached to the plates 60, and 66, respectfully, of the shelving member 14 at different positions in order to provide maximum stability to the shelving member 14.

FIG. 4*a*, which is a cut-a-way view of the connectors 26 and 28 of the shelving member 16 shown in proximity to the perforated shelf 10, illustrates the positioning of the pegs 64 and 68 with respect to the perforated shelf 10 in more detail. Although the following describes the connection mechanism of the shelving member 16, it should be understood that the connection mechanism of the shelving member 14 is constructed using the same principles. The shelving member 16 is fabricated such that the pegs 64 and 68 do not align exactly with the centers of holes 70 and 72, respectively, of the perforated shelf 10 when the shelving member 16 is placed thereon. As illustrated in FIG. 4*a*, when the pegs 68 of connector 28 are located above the centers of the holes 72 of the perforated shelf 10, the pegs 64 of the connector 26 are located off-center of the holes 70 of the perforated shelf 10. In order to insert the pegs 64 and 68 into the holes 70 and 72, respectively, and thereby to attach the shelving member 16 to the perforated shelf 10, the plate 60 of the connector 26 must be moved with respect to the plate 66 of the connector 28.

Thus, as illustrated in FIG. 4*b*, the shelving member 16 can be attached to the perforated shelf 10 by inserting the pegs 68 of the connector 28 into the holes 72 of the perforated shelf 10 and then applying a force, indicated by the arrow in FIG. 4*b*, to the connector 26, by, for example, pulling the plate 33, one of the rods 20 or the plate 62, towards the front of the perforated shelf 10. Applying this force to the connector 26 moves the pegs 64 directly over the centers of the holes 70 of the perforated shelf 10 and allows the pegs 64 to be inserted therein. When the pegs 64 are inserted in the holes 70 and the force is removed from the connector 26, the connector 26 moves back towards the connector 28 and, thereby, causes the U-shaped pegs 64 and 68 to be at positions off-center of their respective holes 70 and 72. In this manner, the upper ends of the U-shaped pegs 64 and 68 are directly below a metal portion of the perforated shelf 10 so that the shelving member 16 is locked onto the perforated shelf 10.

Although shelving members 14 and 16 have been described as having pegged connectors 26 and 28, it should be noted that any other type of desired connection mechanism can be used instead, including, for example, clamps, screws and magnets, in order to attach the shelving members 14 and 16 to the perforated shelf 10. Furthermore, although the shelving members 14 and 16 have been illustrated herein as being connected to the flat shelf 10, the shelving members 14 and 16 could, alternatively, be attached to any other structure, such as the vertically disposed surface 80 shown in FIG. 1, as long as the shelving members 14 and 16 are positioned above, and in proximity to the flat shelf 10. It should also be noted that any number of perforated shelves 10 having shelving members 14 and/or 16 attached thereto can be stacked vertically above one another to form a large shelving system capable of storing and displaying numerous related items, such as photo albums and their associated photo album refills. Still further, while the shelving system 8 has been described as being used in conjunction with a horizontally disposed flat shelf 10, the flat shelf 10 could, alternatively, be disposed diagonally. In such a configuration, the shelving members 14 and 16 could be attached to the flat shelf 10 as shown in FIG. 1 so that the ledges 18 are parallel to the flat shelf 10 or, alternatively, the support members 14 and 16 could be configured so that the rods 20 are either longer or shorter than the rods 22 so as to orient the ledge 18 horizontally even though the flat shelf 10 is disposed diagonally.

Numerous other modifications and alternative embodiments of the invention will be apparent to those skilled in the art in view of the foregoing description. Accordingly, this description is to be construed as illustrative only. The details of the structure may be varied substantially without departing from the spirit of the invention, and the exclusive use of all modifications, which are within the scope of the appended claims, is reserved.

It is claimed:

1. A shelving system adapted for use with a flat shelf having a front edge, the shelving system comprising a first shelving member and a second shelving member, said first and second shelving members being adapted to be disposed on the flat shelf in a spaced-apart manner in order to support an item therebetween by enabling the item to straddle the space above the flat shelf between said first and second shelving members, each of said first and second shelving members including, a ledge adapted to be disposed perpendicularly to the front edge of the flat shelf, a first support member rigidly attached to a first part of said ledge and extends between said ledge and flat shelf when the shelving member is attached to the flat shelf, a second support member rigidly attached to a second part of said ledge and extends between said ledge and flat shelf when he shelving member is attached to the flat shelf, and which is movable with respect to said firs support member, a first rigid connector attached to said first support member adapted to connect said first support member to the flat shelf and disposed at a first predetermined distance below said ledge when said shelving member is attached to the flat shelf, and a second rigid connector attached to said second support member adapted to connect said second support member to the flat shelf and disposed at a second predetermined distance below said ledge when said shelving member is attached to the flat shelf, wherein one of said first and second connectors comprises a peg extending therefrom and having a neck portion adjacent to the one of said connector for insertion into a hole of the flat shelf, said first and second connectors being configured to transfer the weight of the item to the flat shelf, and said first and second predetermined distances being configured to enable an additional item to be disposed between said ledge and the flat shelf when said shelving member is attached to the flat shelf.

2. The shelving system adapted for use with a flat shelf according to claim 1, wherein each of said shelving members includes a lateral support member which extends above said ledge of said shelving member.

3. The shelving system adapted for use with a flat shelf according to claim 2, wherein said lateral support member includes a vertically disposed metal rod connected to said ledge and a horizontally disposed metal rod attached to said vertically disposed metal rod.

4. The shelving system adapted for use with a flat shelf according to claim 3, wherein each of said first and second shelving members further includes a vertically disposed surface adapted for displaying information pertaining to the item or to the additional item.

5. The shelving system adapted for use with a flat shelf according to claim 1, wherein the flat shelf is a perforated shelf having a series of holes therein and wherein each of said first and second connectors includes a peg adapted to be inserted into one of the holes of the perforated shelf.

6. The shelving system adapted for use with a flat shelf according to claim 5, wherein one of said first and second shelving members includes a further ledge adapted to be disposed perpendicularly to the front edge of the flat shelf.

7. The shelving system adapted for use with a flat shelf according to claim 1, wherein the first support member of one of said first and second shelving members is attached to a side of the ledge of the one of said first and second shelving members and the second support member of the one of said first and second shelving members is attached to a middle portion of the ledge of the one of said first and second shelving members.

8. The shelving system adapted for use with a flat shelf according to claim 1, wherein said first and second shelving members are adapted to be disposed on the flat shelf in a plurality of spaced-apart locations.

9. The shelving system adapted for use with a flat shelf according to claim 1, wherein said first and second predetermined distances are greater than one inch.

* * * * *